US006539911B2

(12) United States Patent
Dürr et al.

(10) Patent No.: US 6,539,911 B2
(45) Date of Patent: Apr. 1, 2003

(54) LUBRICATION MECHANISM FOR A CAM DRIVE

(75) Inventors: Bernhard Dürr, Stuttgart (DE); Harald Schliemann, Waiblingen (DE); Reinhard Friedrich, Waiblingen (DE); Manfred Rabis, Schorndorf (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 09/944,762

(22) Filed: Aug. 31, 2001

(65) Prior Publication Data

US 2002/0026920 A1 Mar. 7, 2002

(30) Foreign Application Priority Data

Sep. 2, 2000 (DE) ..... 100 43 236

(51) Int. Cl.[7] ..... F01M 1/00
(52) U.S. Cl. ..... 123/196 R
(58) Field of Search ..... 123/196 R, 196 M, 123/90.33

(56) References Cited

U.S. PATENT DOCUMENTS 5,975,042 A * 11/1999 Aizawa et al. ..... 123/196 R
6,152,098 A * 11/2000 Becker et al. ..... 123/196 R
6,199,532 B1 3/2001 Häberlein et al.

FOREIGN PATENT DOCUMENTS

DE 19848890 A1 4/2000

* cited by examiner

*Primary Examiner*—John Kwon
*Assistant Examiner*—Hyder Ali
(74) *Attorney, Agent, or Firm*—R W Becker & Associates; R W Becker

(57) ABSTRACT

A cam drive is provided for a valve-controlled mixture-lubricated internal combustion engine having a cylinder in which is formed a combustion chamber that is delimited by the cylinder wall, a piston and a cylinder head. Disposed in the cylinder head are poppet valves, the respective valve shafts of which are driven via a pivotable rocker arm from a valve control that includes a control cam on the surface of which rests a contact lever that transfers cam lift to one end of the rocker arm. To ensure good lubrication of the cam drive even at high speeds, the control cam is rotatably mounted in the vicinity of the cylinder wall, in which is formed a through-bore. The first open end of the through-bore is disposed in the cylinder bore at the level of the piston in its lower dead center position, while the second open end opens into the cam chamber in the vicinity of the control cam.

19 Claims, 5 Drawing Sheets

LUBRICATION MECHANISM FOR A CAM DRIVE

BACKGROUND OF THE INVENTION

The present invention relates to a cam drive for an internal combustion engine in a manually guided implement, especially for a valve-controlled, mixture-lubricated internal combustion engine.

DE 198 48 890 A1 discloses a mixture-lubricated, valve-controlled internal combustion engine according to which the mixture that is supplied to the combustion chamber is supplied via an intake channel and an intake valve. To ensure lubrication of the valve drive and the crank assembly, the valve housing is connected via a connection bore with the mixture-supplying channel, and the crankcase is connected to the valve housing via a channel. During the pulsation in the intake cycle there also results a mixture exchange, and hence a lubrication in the chambers that are connected only via a flow path.

Valve-controlled two-stroke or four-stroke engines run at high speeds, so that the surfaces of the control cams, as well as the cam drive itself, are subjected to high stresses. This can lead to premature wear, especially when there is a lack of lubricating oil.

It is therefore an object of the present invention to improve a cam drive of a valve-controlled internal combustion engine in such a way that in particular during a mixture lubrication an adequate supply of lubricating oil to the moving parts is ensured.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
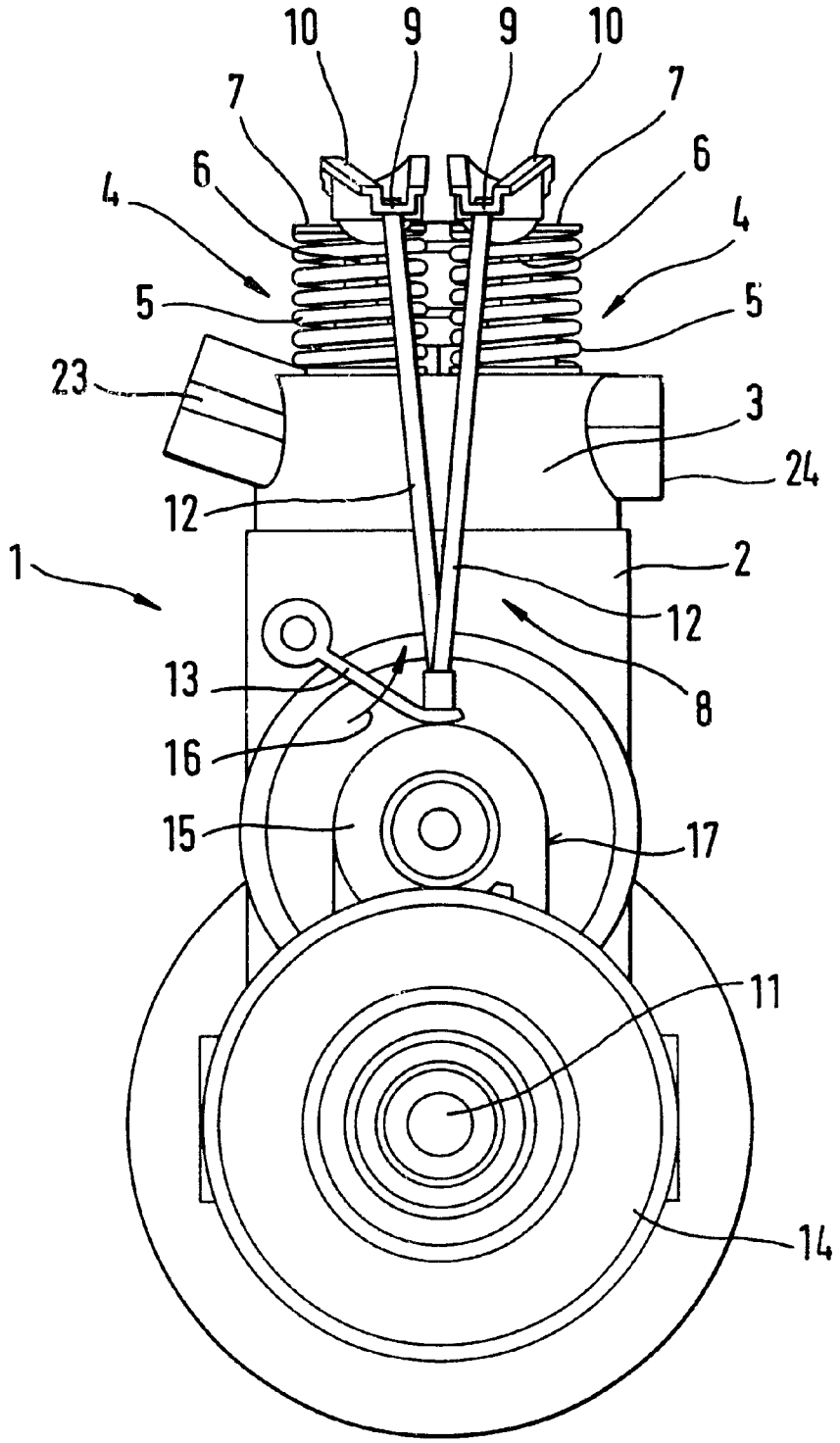
FIG. 1 is a view of a valve-controlled internal combustion engine having poppet valves that are actuated by push rods.

The cam drive of the present invention is provided for an internal combustion engine having a cylinder in which is formed a combustion chamber that is delimited by a cylinder wall, a cylinder head and a piston, wherein disposed in the cylinder head is a poppet valve, a valve stem of which is driven by a pivotable rocker arm from a valve control mechanism that is provided with a control cam, on the cam surface of which rests a contact lever that transfers the cam lift to one end of the rocker arm, wherein the control cam is rotatably mounted in a cam chamber in the vicinity of the cylinder wall, wherein a through-bore is formed in the cylinder wall, wherein a first open end of the through-bore is disposed in a cylinder bore at a level of the piston when the latter is in a lower dead center position, and wherein a second open end of the through-bore opens into the cam chamber in the vicinity of the control cam.

The through-bore that is provided in the cylinder wall ensures that with every stroke of the piston lubricating oil is conveyed into the cam chamber. With every downward movement of the piston, the piston ring wipes the lubricating oil that is disposed in the cylinder bore in a direction toward the crankcase, where due to the high piston speeds of up to 20,000 revolutions per minute the lubricating oil is pressurized in the region of the piston ring during the movement of the piston. This pressure is inventively utilized to convey the lubricating oil into the through-bore and hence to ensure a supply of lubricating oil to the cam drive with straightforward means.

When the piston is in the lower dead center position, the first open end of the through-bore is preferably disposed approximately at the level of the piston rings. In this connection, the second open end of the through-bore can open into the cam chamber at the level of an end face of the control cam; the through-bore is preferably disposed directly across from the end face of a cam drive wheel.

It can also be expedient to allow the second open end of the through-bore to open directly into the bearing chamber of the control cam, or to supply a connecting channel that opens into the bearing chamber, for which purpose the second open end of the through-bore can be disposed across from the end face of a central journal pin of the cam drive. In this connection, the connecting channel branches off from the end face to the bearing chamber.

In order to also lubricate the cam surfaces, a lubricating channel can be disposed in the control cam that is oriented essentially radially and opens out in the cam surface; this lubricating channel is in flow communication with the bearing chamber.

In order to collect the lubricating oil wiped off from the piston ring in the region of the open first end of the through-bore in an efficient manner, it is proposed to radially recess a partial periphery of the side wall of the piston skirt relative to the interior of the piston in such a way that there is formed between the side wall, the edge of the piston skirt and the cylinder bore, a collecting chamber for lubricating oil that is open to the crankcase. For a further concentration of the lubricating oil, it can be expedient for the collecting chamber to taper in the longitudinal direction of the piston in a direction toward the piston ring groove. If at its tapered end the collecting chamber merges with the piston end groove, lubricating oil that accumulates in the piston ring groove also flows into the collecting chamber.

Further specific features of the present invention will be described in detail subsequently.

DESCRIPTION OF PREFERRED EMBODIMENTS

Referring now to the drawings in detail, the internal combustion engine 1 that is schematically illustrated in FIG. 1 essentially comprises a cylinder 2, a crankcase 14, and a cylinder head 3. Provided in the cylinder head 3 are poppet valves 4, which are not shown in detail, the valve stems 6 of which are coaxially surrounded by valve springs 5. One end of each of the valve springs 5 is supported on the cylinder head 3, while the other end is supported on a valve disk 7 that is secured to the valve stem 6 in an axially non-displaceable manner.

During operation of the internal combustion engine, each valve stem 6 is actuated by a valve control mechanism 8 that by means of push rods 12 engages one end 9 of a rocker arm 10 that is pivotably mounted on the cylinder head 3. The pivotable mounting of the rocker arm 10 is provided between its ends, so that the movement of the end 9 that is on the push rod side is transferred to the other end of the rocker arm, as a result of which the valve stem 6 is correspondingly actuated.

One end of each of the push rods 12 is held on the rocker arm 10, while the other end is held on a drag or contact lever 13. The contact lever 13 is pivotably mounted, and one portion thereof rests upon the cam surface 17 of a control cam 15 and is actuated in the direction of the arrow 16 in conformity with the cam lift of the cam surface 17. In so doing, the push rod 12 is displaced axially in the same direction, as a result of which the rocker arm 10 is pivoted about its pivot axis, which is disposed transverse to its longitudinal direction, and the respective valve stem of the actuated poppet valve 4 is pressed down, thereby opening the intake or exhaust valve. The intake valve communicates with an intake channel 23, via which the fresh mixture is supplied. The outlet valve communicates with an exhaust gas channel 24 that opens into a non-illustrated muffler.

The control cams 15 which are designed separately or in common for the intake valve and the exhaust valve are driven by the crankshaft 11 of the internal combustion engine 1, preferably by means of a gear drive, a chain drive, or a belt drive. The crankshaft 11 rotates in the crankcase 14.

Figure 2:
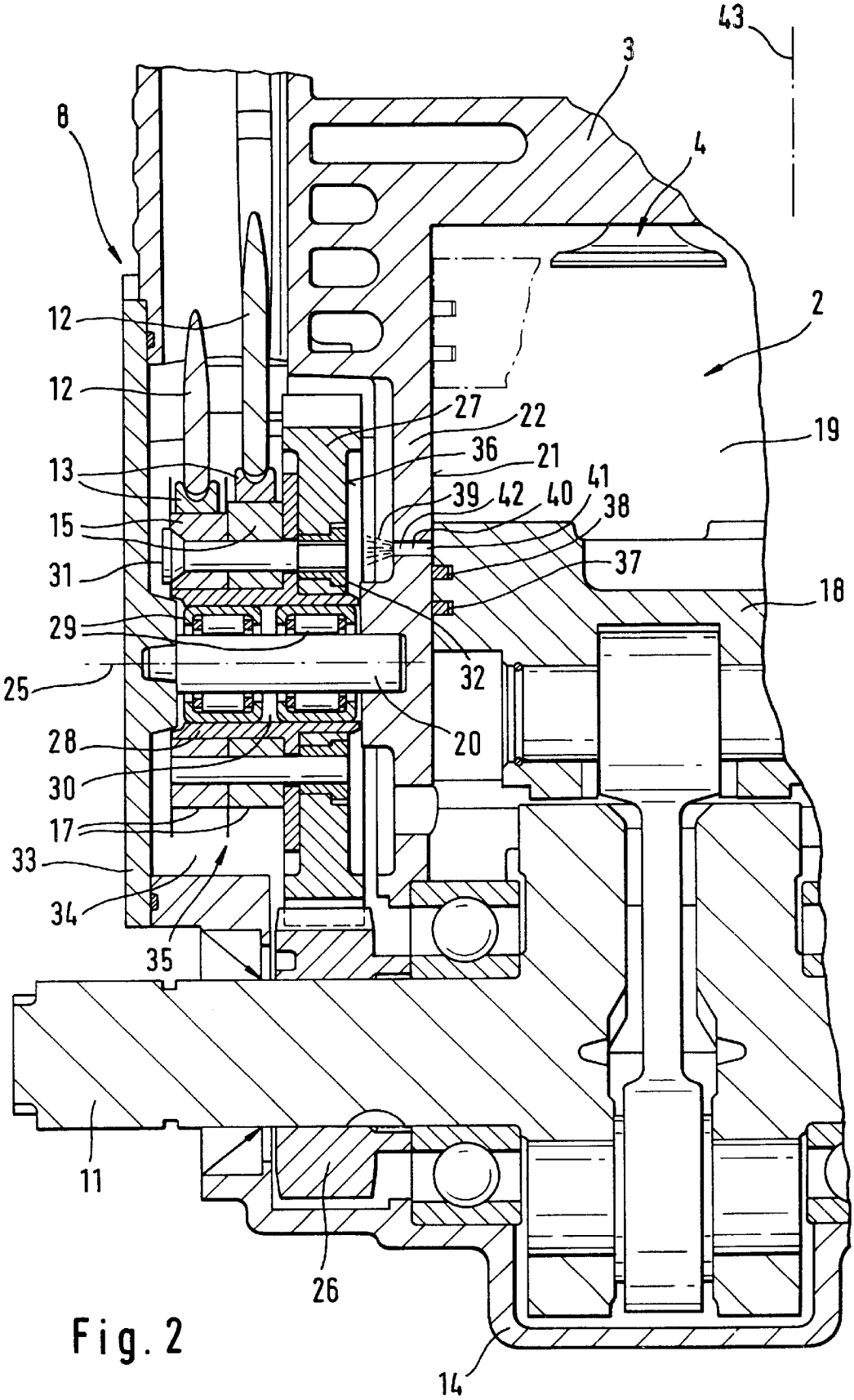
FIG. 2 is an enlarged view of that portion of the internal combustion engine of FIG. 1 that pertains to the cam drive.

FIG. 2 is an enlarged view of the cam drive for the actuation of the push rods 12. In the illustrated embodiment, the cam drive is provided at the level of the cylinder 2; in the cylinder wall 22, next to the crankshaft 11, a journal pin 20 is held, the axis 25 of which is disposed parallel to the axis of the crankshaft 11.

In the cylinder 2 a combustion chamber 19 is formed that is delimited by the piston 18, the cylinder wall 22 and the cylinder head 3. As schematically illustrated in the upper right hand portion of FIG. 2, in the cylinder head 3 the poppet valves are provided that, by means of the rocker arms 10 illustrated in FIG. 1, are actuated by the valve control mechanism 8 via the push rods 12.

Fixed in position on the crankshaft 11 is a drive gear or pinion 26 that meshes with a toothed cam drive wheel 27. The drive wheel 27 is held on a hub 28 that is rotatably mounted on the journal pin 20. In the illustrated embodiment, the hub 28 is held on the journal pin 20 via bearing means 29, preferably roller or needle bearings; between the hub 28 and the journal pin 20 a bearing chamber 30 is furthermore formed.

The control cams 15 are threaded onto the hub 28 and together with the cam drive wheel 27, are fixedly cottered on the hub 28 such that they are offset relative to one another in a rotational position in conformity with the desired control times. For this purpose, split or cotter pins 31 which are disposed parallel to the journal pin 20 are introduced into aligned holes of the control cams 15 and of the cam drive wheel 27; the pins or screws 31 are secured with a nut 32. The control cams 15, the hub 28 and the cam drive wheel 27 thus form a common component that is rotatably held upon the journal pin 20 via the bearing means 29. The hub 28 is axially secured by a housing cover 33 that closes off the cam chamber 34 and in which the free end of the journal pin 20 can be supported.

For the lubrication of the cam drive 35 a through-bore 40 is provided in the cylinder wall 22. The first, open end 41 of the through-bore 40 opens into the cylinder 2 at the level of the piston 18 when it is in its lower dead center position. The first, open end 41 is thus disposed in the cylinder bore 21. The lower dead center position of the piston 18 is shown in FIG. 2.

The second open end of the through-bore 40 opens out into the cam chamber 34 in the vicinity of the control cams 15. In the illustrated embodiment, the second, open end 42 is disposed approximately at the level of an end face of one of the control cams 15. In this connection, as shown in FIG. 2, the second open end 42 is disposed across from the facing end face 36 of the cam drive wheel 27. The position is selected such that the open end 42 is disposed radially closer to the journal pin 20 than to the teeth of the cam drive wheel 27.

As illustrated in FIG. 2, with the piston 18 in the lower dead center position, the first, open end 41 of the through-bore 40 is disposed approximately at the level of the piston rings 37 and 38. Consequently, during a downward movement of the piston 18, the oil that is wiped off by the piston rings 37 and 38, and that due to this wiping-off movement is under pressure, is pressed into the through-bore 40 and enters the cam chamber 34 as a squirt of oil, as the oil mist 39, or the like. This ensures a good lubrication of the cam drive 35.

In FIG. 2, the position of the through-bore 40 is provided in the direction of the vertical cylinder axis 43 such that the open end 41 of the through-bore 40 is disposed above the upper piston ring 38 in the lower dead center position of the piston 18 that is illustrated in FIG. 2. As a result, oil that has been wiped off into the through-bore 40 can easily be transported into the cam chamber 34 by a residual gas pressure that is present in the combustion chamber 19. Thus, the open end 41 of the through-bore 40 is alternately disposed during operation on the combustion chamber side or the oil side of the piston rings 37 and 38.

Figure 3:
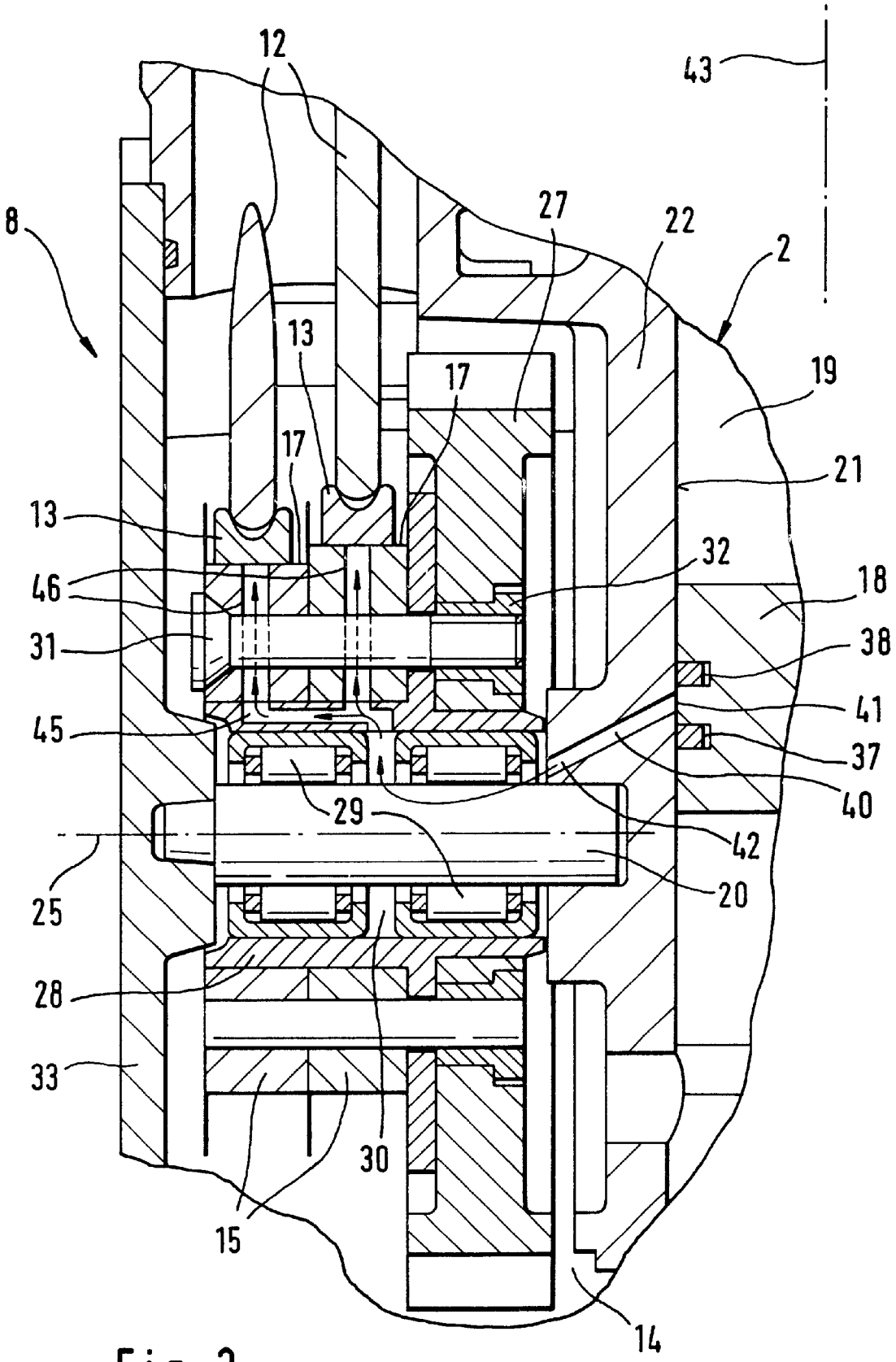
FIG. 3 is a detailed illustration of a cam drive for a valve-controlled internal combustion engine having a lubricating oil channel that opens into the bearing chamber of the control cam mounting.

FIG. 3 is an enlarged portion of part of FIG. 2, whereby the through-bore 40 is inclined from the first open end 41 on the cylinder side to the open second end 42 on the cam chamber side. The through-bore 40 extends approximately at an angle of 30° relative to the vertical cylinder axis 43. It should be noted that angular positions could also be expedient.

As shown in FIG. 3, the first, open end 41 of the through-bore 40 is, in the illustrated lower dead center position of the piston 18, disposed between the piston rings 37 and 38. Thus, merely the lower piston ring 37 passes over the open end 41 in the cylinder bore 21.

As a further modification of the embodiment of FIG. 2, the second open end 42 of the through-bore 40 opens directly into the bearing chamber 30 of the hub 28 of the control cam 15. In this way, the pressurized oil that is wiped off by the piston ring 37 is pressed into the bearing chamber 30 and ensures a good lubrication of the bearing mechanism.

It can be expedient to provide in the hub 28, a distribution or branch channel 45 that is supplied from the bearing chamber 30. The branch channel 45 communicates with lubricating channels 46 that are embodied in the control cams 15 as essentially radial channels and open out in the cam surface 17. Although pursuant to the present invention the pressurized oil wiped off by the piston rings 37 and 38 is supplied under pressure to the through-bore 40 and the bearing chamber 30, this pressure is not always adequate to transport the lubricating oil to the cam surface 17. Since the valve-controlled internal combustion engine 1 which is provided with the cam drive 35 and that can be mixture lubricated as a two-stroke or also a four-stroke engine, has a small piston displacement of approximately 20–120 $cm^3$, and high speeds of 12,000 to 20,000 revolutions per minute, the control cams 15 have a considerable circumferential speed. Due to the high speed of the control cams 15, oil that enters the lubricating channels 46 is conveyed by the effective centrifugal forces to the cam surface 17, whereby at the same time a slight partial vacuum can result in the region of the branch channel 45 that enhances a further flow of lubricating oil out of the bearing chamber 30. The branch channel 45 and the lubricating channels 46 can furthermore have such a narrow configuration that a transport of lubricating oil through the branch channel 45 and the lubricating channel 46 to the cam surface 17 is also possible due to capillary action.

Figure 4:
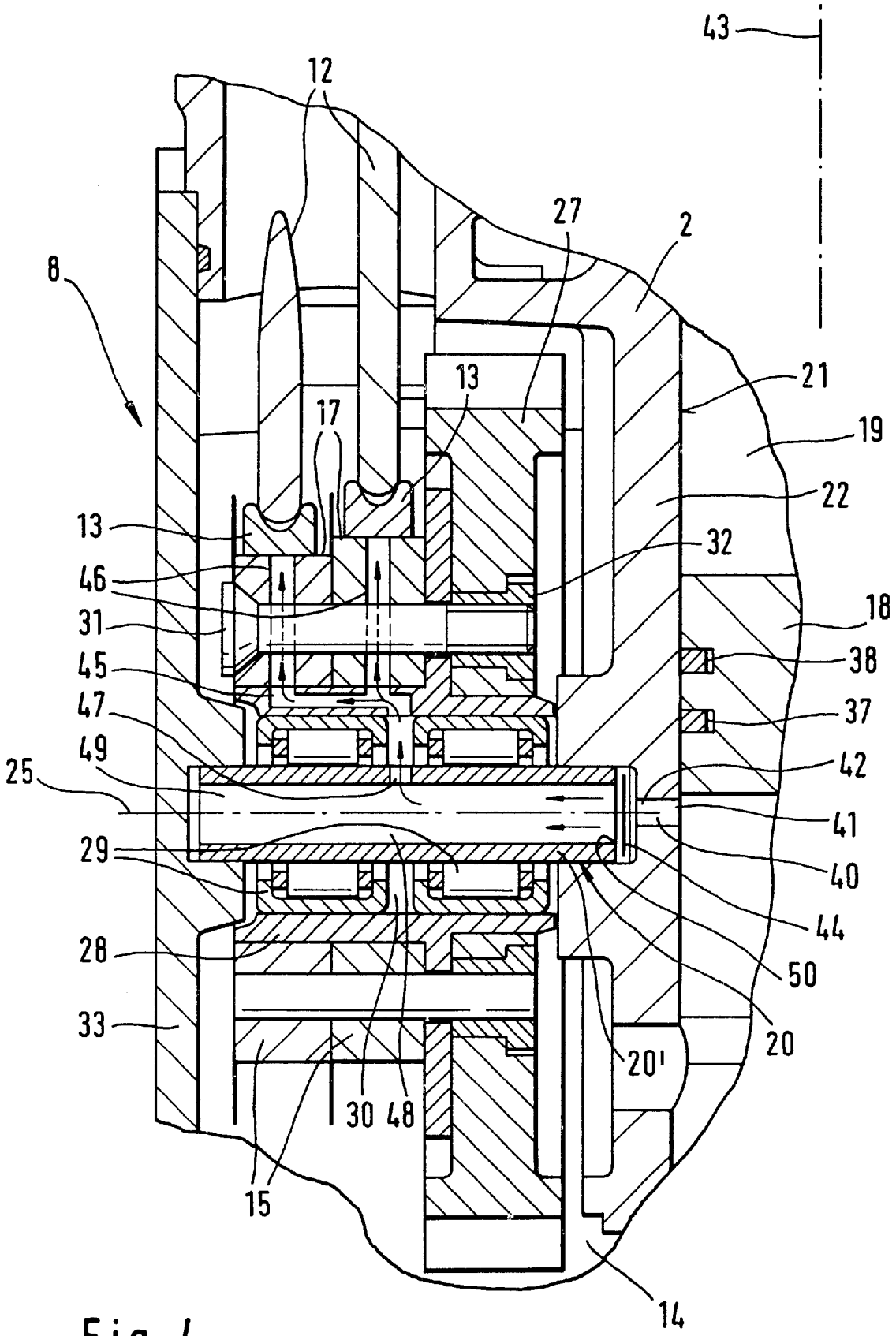
FIG. 4 is an illustration of the cam drive of FIG. 3 with a lubricating oil channel that ends on an end face of the journal pin.

The construction of the cam drive according to FIG. 4 corresponds essentially to that of FIG. 3, for which reason the same reference numerals are used for the same parts. In this embodiment, in the lower dead center position of the piston 18, the first open end 41 of the through-bore 40 is disposed below the lower piston ring 37. The oil wiped off by the piston ring 37 collects in the region of a collecting chamber 59 that is formed in the piston 18; the collecting chamber is illustrated in detail in FIGS. 5 to 7. Due to the stroke speed of the piston 18, the lubricating oil in the collecting chamber 59 is under pressure and thus enters into the through-bore 40, from which it exits via the other open end 42 at the end face of the journal pin 20. In the embodiment illustrated in FIG. 4, the journal pin 20 is embodied as a tubular member 20' and has a transverse passage 47 that is formed in the tube wall and by means of which a communication is established between the inner chamber 48 of the tube and the bearing chamber 30. The inner chamber 48 of the tubular member 20' thus forms a connecting channel 49 between the through-bore 40 and the bearing chamber 30.

A small valve plate 44 is expediently disposed between the end face 50 of the journal pin 20 and the through-bore 40; this valve plate 44 is intended to prevent the bearing chamber 30 from becoming dry. Furthermore, the small valve plate 44 closes off the connecting channel 49 for the period of time in which a partial vacuum exists in the crankcase 14.

Figure 5:
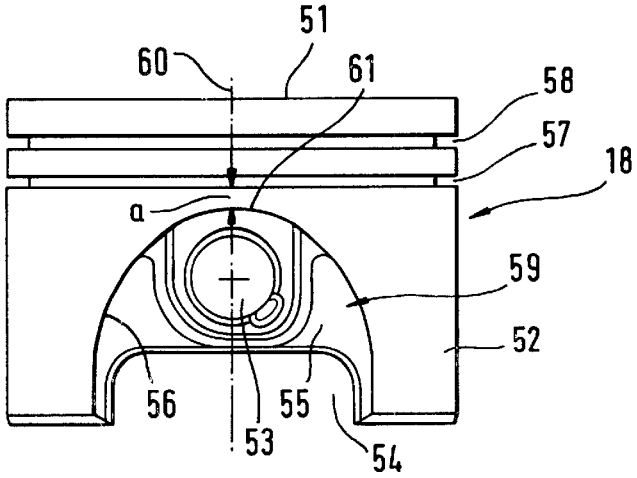
FIG. 5 is a side view of a piston having a collecting chamber for lubricating oil formed in the piston skirts.
Figure 6:
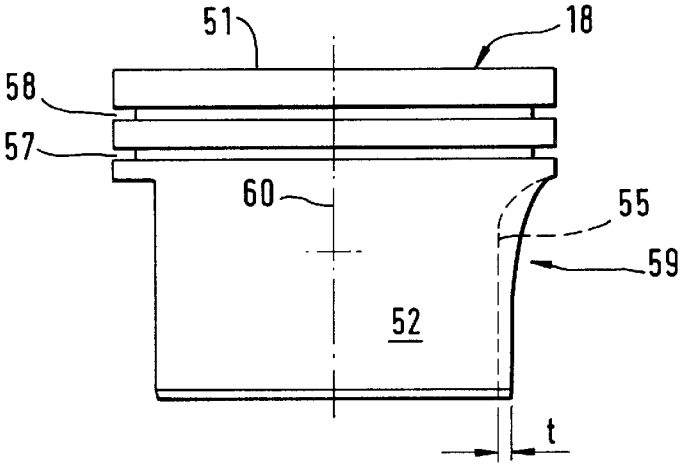
FIG. 6 is a view of the piston of FIG. 5 rotated by 90°.
Figure 7:
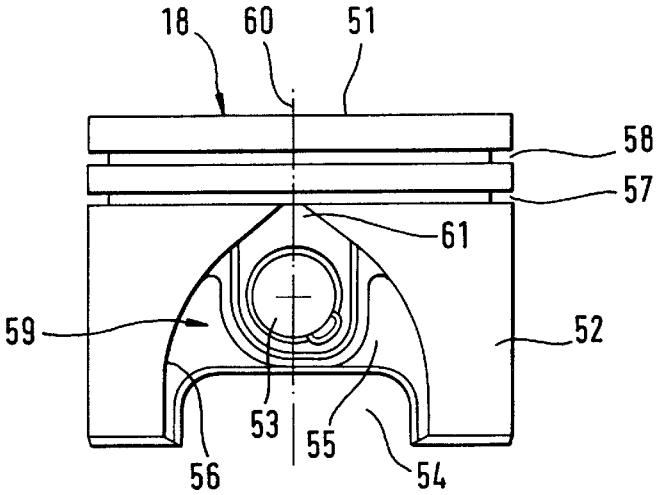
FIG. 7 shows a further embodiment of a piston having a collecting chamber for lubricating oil.

FIGS. 5 to 7 show pistons 18 that in the vicinity of the piston head 51 have two circumferential ring grooves 57 and 58. In the vicinity of the connecting rod pin openings 53, the piston skirt 52 is provided with piston windows 54 that in the illustrated embodiments of FIGS. 2 and 4, in the mounted position of the piston 18, face the through-bore 40.

The side wall 55 of the piston that is provided with a connecting rod pin opening 53 is offset relative to the piston skirt 52 by a radial distance "t" relative to the interior of the piston, so that when the piston is installed, the collecting chamber 59 for lubricating oil is formed between the recessed side wall 55, the edge 56 of the piston skirt 52, and the cylinder bore 21. The collecting chamber 59 is open toward the crankcase 14 and extends in the direction of the longitudinal axis 60 of the piston in a tapering manner toward the piston ring grooves 57 and 58. As shown in FIG. 5, the collecting chamber 59 ends in the direction of the longitudinal axis 60 of the piston at a slight distance "a" below the lower piston ring groove 57. It can be advantageous to allow the tapered end 61 of the collecting chamber 59 to merge with the piston ring groove 57, as illustrated in FIG. 7.

When the piston is moving in a direction toward the lower dead center point, the oil wiped off by the lower, piston ring 37 collects in the collecting chamber 59, whereby due to the fact that the piston is moving at high speed to the lower dead center position, the lubricating oil accumulates under pressure at the tapered end 61 of the collecting chamber 59. The structural configuration is such that in the region of the lower dead center position of the piston 18, the first, open end 41 of the through-bore 40 is approximately aligned with the tapered end 61 of the collecting chamber 59. The pressurized lubricating oil at the tapered end 61 is therefore conveyed through the through-bore 40 in a direction toward the cam chamber 34. The open, first end 41 of the through-bore 40 is advantageously disposed approximately on the path of movement on the tapered end 61 of the collecting chamber 59, which path of movement is provided in the upper direction of the cylinder.

The specification incorporates by reference the disclosure of German priority document 100 43 236.0 filed Sep. 02 2000.

The present invention is, of course, in no way restricted to the specific disclosure of the specification and drawings, but also encompasses any modifications within the scope of the appended claims.

We claim:

1. In a cam drive for an internal combustion engine, in a manually guided implement, having a cylinder in which is formed a combustion chamber that is delimited by a cylinder wall, a cylinder head, and a piston disposed in the cylinder, wherein disposed in said cylinder head is a poppet valve, a valve stem of which is driven by a pivotable rocker arm from a valve control mechanism that is provided with a control cam having a cam surface on which rests a contact lever that transfers cam lift to one end of said rocker arm, the improvement wherein:

said control cam is rotatably mounted in a cam chamber in the vicinity of said cylinder wall, wherein a through-bore is formed in said cylinder wall, wherein a first open end of said through-bore is disposed in a cylinder bore of said cylinder wall at a level of said piston when the latter is in a lower dead center position, and wherein a second open end of said through-bore opens into said cam chamber in the vicinity of said control cam approximately at a level of an end face of said control cam.

2. A cam drive according to claim 1, wherein said piston is provided with piston rings and wherein said first open end of said through-bore is disposed approximately at the level of said piston rings when said piston is in a lower dead center position.

3. A cam drive according to claim 1, wherein said control cam is provided with an essentially radially oriented lubricating channel that opens out in said cam surface, and wherein said lubricating channel is in flow communication with a bearing chamber of said control cam.

4. A cam drive according to claim 3, wherein said flow communication between said lubricating channel and said bearing chamber is formed by a branch channel that is provided in a hub of said control cam.

5. A cam drive according to claim 1, wherein said through-bore is inclined from said first open end to said second open end.

6. A cam drive according to claim 1, wherein a partial periphery of a side wall of a piston skirt is radially recessed relative to the interior of said piston in such a way that a collecting chamber for lubricating oil is formed between said side wall, an edge of said piston skirt and said cylinder bore, and wherein said collecting chamber is open toward a crankcase of said internal combustion engine.

7. A cam drive according to claim 6, wherein said collecting chamber, in a longitudinal axis of said piston, tapers in a direction toward a piston ring groove of said piston.

8. A cam drive according to claim 7, wherein said collecting chamber ends shortly below said piston ring groove.

9. A cam drive according to claim 7, wherein said collecting chamber merges into said piston ring groove.

10. In a cam drive for an internal combustion engine, in a manually guided implement, having a cylinder in which is formed a combustion chamber that is delimited by a cylinder wall, a cylinder head, and a piston disposed in the cylinder, wherein disposed in said cylinder head is a poppet valve, a valve stem of which is driven by a pivotable rocker arm from a valve control mechanism that is provided with a control cam having a cam surface on which rests a contact lever that transfers cam lift to one end of said rocker arm, the improvement wherein:

said control cam is rotatably mounted in a cam chamber in the vicinity of said cylinder wall, wherein a through-bore is formed in said cylinder wall, wherein a first open end of said through-bore is disposed in a cylinder bore of said cylinder wall at a level of said piston when the latter is in a lower dead center position, and wherein a second open end of said through-bore opens into said cam chamber in the vicinity of said control cam and is disposed directly across from an end face of a cam drive wheel.

11. A cam drive according to claim 10, wherein said second open end of said through-bore opens into said cam chamber approximately at a level of an end face of said control cam.

12. In a cam drive for an internal combustion engine, in a manually guided implement, having a cylinder in which is formed a combustion chamber that is delimited by a cylinder wall, a cylinder head, and a piston disposed in the cylinder, wherein disposed in said cylinder head is a poppet valve, a valve stem of which is driven by a pivotable rocker arm from a valve control mechanism that is provided with a control cam having a cam surface on which rests a contact lever that transfers cam lift to one end of said rocker arm, the improvement wherein:

said control cam is rotatably mounted in a cam chamber in the vicinity of said cylinder wall, wherein a through-bore is formed in said cylinder wall, wherein a first open end of said through-bore is disposed in a cylinder bore of said cylinder wall at a level of said piston when the latter is in a lower dead center position, and wherein a second open end of said through-bore opens into an inner bearing chamber of said control cam.

13. A cam drive according to claim 12, wherein said control cam is provided with an essentially radially oriented lubricating channel that opens out in said cam surface, and wherein said lubricating channel is in flow communication with a bearing chamber of said control cam.

14. A cam drive according to claim 13, wherein said flow communication between said lubricating channel and said bearing chamber is formed by a branch channel that is provided in a hub of said control cam.

15. A cam drive according to claim 12, wherein said through-bore is inclined from said first open end to said second open end.

16. In a cam drive for an internal combustion engine, in a manually guided implement, having a cylinder in which is formed a combustion chamber that is delimited by a cylinder wall, a cylinder head, and a piston disposed in the cylinder, wherein disposed in said cylinder head is a poppet valve, a valve stem of which is driven by a pivotable rocker arm from a valve control mechanism that is provided with a control cam having a cam surface on which rests a contact lever that transfers cam lift to one end of said rocker arm, the improvement wherein:

said control cam is rotatably mounted in a cam chamber in the vicinity of said cylinder wall, wherein a through-bore is formed in said cylinder wall, wherein a first open end of said through-bore is disposed in a cylinder bore of said cylinder wall at a level of said piston when the latter is in a lower dead center position, wherein a second open end of said through-bore opens into said cam chamber in the vicinity of said control cam and is disposed across from an end face of a central journal pin of said cam drive, and wherein said journal pin is provided with a central connecting channel that opens into a bearing chamber of said control cam.

17. A cam drive according to claim 16, wherein said journal pin is embodied as a tubular member having a tube wall that is provided with a transverse passage that opens into said bearing chamber.

18. A cam drive according to claim 16, wherein a small valve plate is disposed between said second open end of said through-bore and said end face of said journal pin.

19. In a cam drive for an internal combustion engine, in a manually guided implement, having a cylinder in which is formed a combustion chamber that is delimited by a cylinder wall, a cylinder head, and a piston disposed in the cylinder, wherein disposed in said cylinder head is a poppet valve, a valve stem of which is driven by a pivotable rocker arm from a valve control mechanism that is provided with a control cam having a cam surface on which rests a contact lever that transfers cam lift to one end of said rocker arm, the improvement wherein:

said control cam is rotatably mounted in a cam chamber in the vicinity of said cylinder wall, wherein a through-bore is formed in said cylinder wall, wherein a first open end of said through-bore is disposed in a cylinder bore of said cylinder wall at a level of said piston when the latter is in a lower dead center position, wherein a second open end of said through-bore opens into said cam chamber in the vicinity of said control cam, wherein said control cam is provided with an essentially radially oriented lubricating channel that opens out in said cam surface, and wherein said lubricating channel is in flow communication with a bearing chamber of said control cam.

* * * * *